US005321483A

United States Patent [19]

Yokoyama et al.

[11] Patent Number: 5,321,483

[45] Date of Patent: Jun. 14, 1994

[54] CLEANING DEVICE FOR IMAGE FORMING EQUIPMENT

[75] Inventors: Masato Yokoyama, Yokohama; Sadao Takahashi, Tokyo; Masaru Tanaka, Yokohama, all of Japan

[73] Assignee: Ricoh Company, Ltd., Tokyo, Japan

[21] Appl. No.: 914,598

[22] Filed: Jul. 20, 1992

[30] Foreign Application Priority Data

Jul. 20, 1991 [JP] Japan ..... 3-204711
Mar. 31, 1992 [JP] Japan ..... 4-105938

[51] Int. Cl.[5] ..... G03G 21/00
[52] U.S. Cl. ..... 355/299; 15/256.51
[58] Field of Search ..... 355/298, 299, 296; 15/256.51, 256.52

[56] References Cited

U.S. PATENT DOCUMENTS

| | | | |
|---|---|---|---|
| Re. 30,924 | 1/1975 | Katayama et al. | 15/256.51 |
| 3,660,863 | 5/1972 | Gerbasi | 355/299 |
| 4,026,648 | 5/1977 | Takahashi | 355/299 |
| 4,440,488 | 4/1984 | Maekawa et al. | 355/299 |
| 4,451,140 | 5/1984 | Saito | 355/299 |
| 4,469,434 | 9/1984 | Yamazaki et al. | 15/256.51 X |
| 4,519,698 | 5/1985 | Kohyama et al. | 355/299 |
| 4,568,175 | 2/1986 | Inowa et al. | 355/299 |
| 4,619,523 | 10/1986 | Maeda et al. | 355/299 |
| 4,992,834 | 2/1991 | Yamamoto et al. | 355/299 |
| 5,043,769 | 8/1991 | Osawa et al. | 355/299 |
| 5,122,839 | 6/1992 | Siegel et al. | 355/299 |
| 5,211,864 | 5/1993 | Godlove | 355/299 |

*Primary Examiner*—A. T. Grimley
*Assistant Examiner*—Shuk Y. Lee
*Attorney, Agent, or Firm*—Oblon, Spivak, McClelland, Maier & Neustadt

[57] ABSTRACT

A cleaning device incorporated in image forming equipment and capable of exhibiting a desirable cleaning ability while in operation. Various characteristic values determining the cleaning angle during cleaning operation, e.g., the Young's modulus and thickness of a cleaning blade and the amount of protrusion of the blade from a holder are selected to satisfy a particular relation.

6 Claims, 5 Drawing Sheets

CLEANING DEVICE FOR IMAGE FORMING EQUIPMENT

BACKGROUND OF THE INVENTION

1. Field of the Invention

The present invention relates to a cleaning device for a copier, facsimile transceiver, printer or similar image forming equipment and, more particularly, to a cleaning device of the type scraping off a toner remaining on the surface of an image carrier made of photoconductor by having the ridge of the free end thereof pressed against the the image carrier.

2. Discussion of the Background

A cleaning device of the type described has a blade support mounted on an axis which is parallel to the surface of the image carrier and perpendicular to an intended direction of movement of the surface, and a cleaning blade affixed to the free end of the blade support such that the free end of the blade protrudes a predetermined amount from that of the blade support. The cleaning blade is pressed via the support member to have the free end thereof urged against the surface of the image carrier. In this condition, the end face of the cleaning blade stops and scrapes off a toner remaining on the image carrier. This type of cleaning device is disclosed in, for example, Japanese Patent Laid-Open Publication No. 156284/1990. This Laid-Open Publication includes an implementation for eliminating excessive wear of the surface of the image carrier, defective drive of the image carrier, defective cleaning occurring when the free end of the blade is entrained by the image carrier, etc. The implementation is such that the surface of the cleaning blade facing the image carrier and a line tangential to the surface of the image carrier at the point where the blade contacts the image carrier have an angle, or contact angle, of 9.5–14.5 degrees therebetween, while the blade is pressed against the image carrier by a force of 0.1–10 g/mm.

However, the above-mentioned contact angle and other factors of concern should not be set up when the surface of the image carrier is not moving relative to the cleaning blade for the following reasons. While a cleaning operation is under way, the free end of the cleaning blade is deformed by friction ascribable to the movement of the surface of the image carrier relative to the blade. As a result, the angle between the end face of the cleaning blade and the line tangential to the surface of the image carrier at the point of contact, i.e., the cleaning angle, changes. The cleaning angle is one of major factors that determine the ability of the cleaning device. The degree of such deformation of the cleaning blade before and after the movement of the surface of the image carrier depends on the Young's modulus E and thickness t of the blade, the distance l over which the blade protrudes from the blade support, etc.

Therefore, to achieve a desirable cleaning ability, it is necessary that the Young's module E, thickness t and protuberance l of the cleaning blade as well as other factors of concern be so selected as to set up an adequate cleaning angle during cleaning operation.

SUMMARY OF THE INVENTION

It is therefore an object of the present invention to provide a cleaning device for image forming equipment capable of setting up a particular cleaning angle during cleaning operation which insures a desirable cleaning ability.

In accordance with the present invention, in a cleaning device comprising a blade support supported by a shaft which is parallel to a surface of an image carrier and perpendicular to an intended direction of movement of the surface, and a cleaning blade affixed to the blade support such that the free end of the cleaning blade protrudes a predetermined amount from the free end of the blade support, the free end of the cleaning blade being pressed against the surface of the image carrier via the blade support for removing a toner remaining on the surface, the following equation is satisfied:

$$\theta_1 = 90^\circ - \beta_0 - \tan^{-1}\left(\frac{4Nl^3 \times 10^{-3}}{Et^3} \times \frac{M-1}{Ml}\right) - \frac{1.08\,Nl^2}{Et^3\pi}$$

where E is the Young's modulus of the cleaning blade, t is the thickness of the cleaning blade, l is the predetermined amount, $\beta_o$ is an angle set up, when the pressure acting on the cleaning blade via the support member is cancelled and the ridge of the free end of the cleaning blade is held in contact with the surface of the image carrier, between the surface of the cleaning blade facing the surface of the image carrier and a line tangential to the surface of the image carrier at a point of contact of the ridge, M is a distance between the center of the shaft and the point of contact under the above condition, N is a load acting on every unit length of the cleaning blade in a widthwise direction while a cleaning operation is under way, and $\theta_1$ is greater than or equal to 78 degrees and smaller than 90 degrees.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

A preferred embodiment of the cleaning device in accordance with the present invention will be described which is incorporated in an electrophotographic copier by way of example.

Figure 1A:
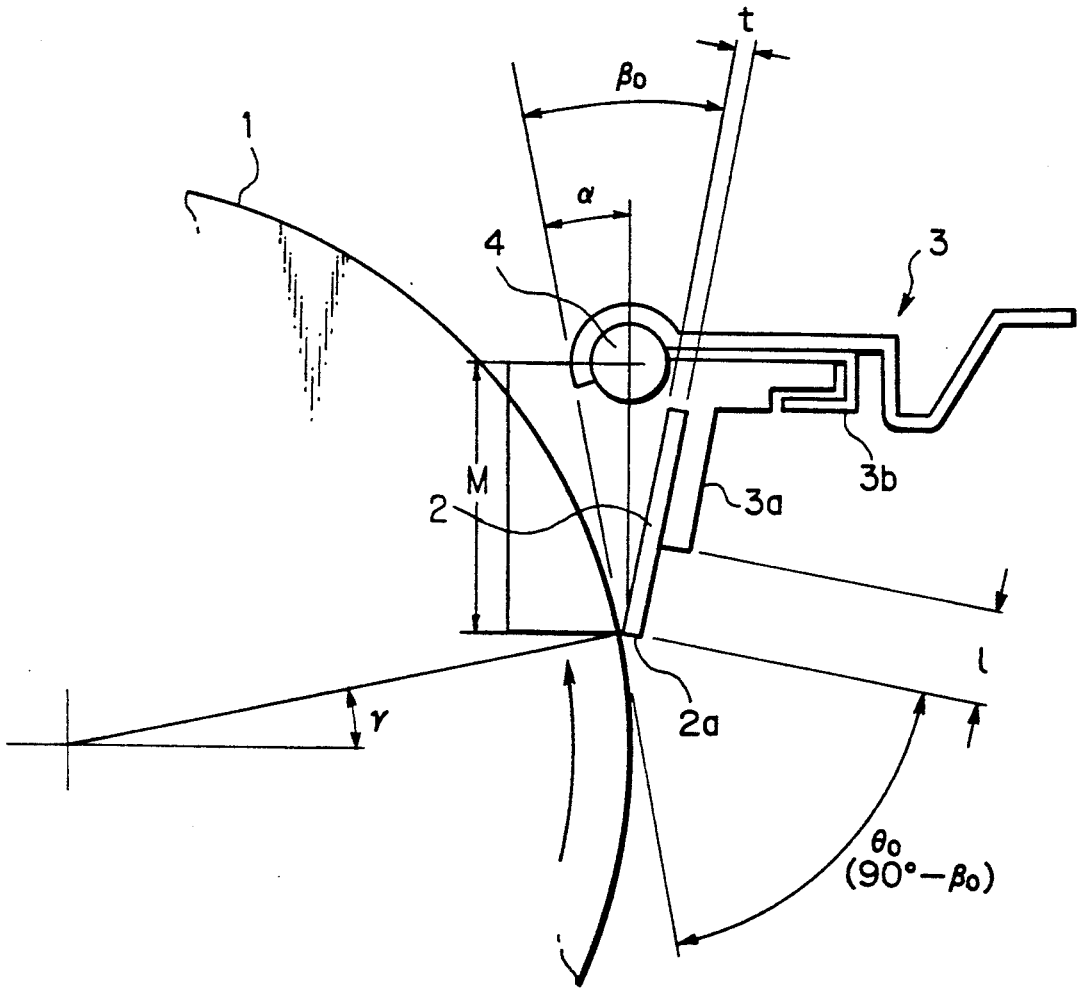
FIGS. 1A and 1B show a cleaning blade included in a cleaning device embodying the present invention in an unstressed position and a stressed or operative position, respectively.
Figure 1B:
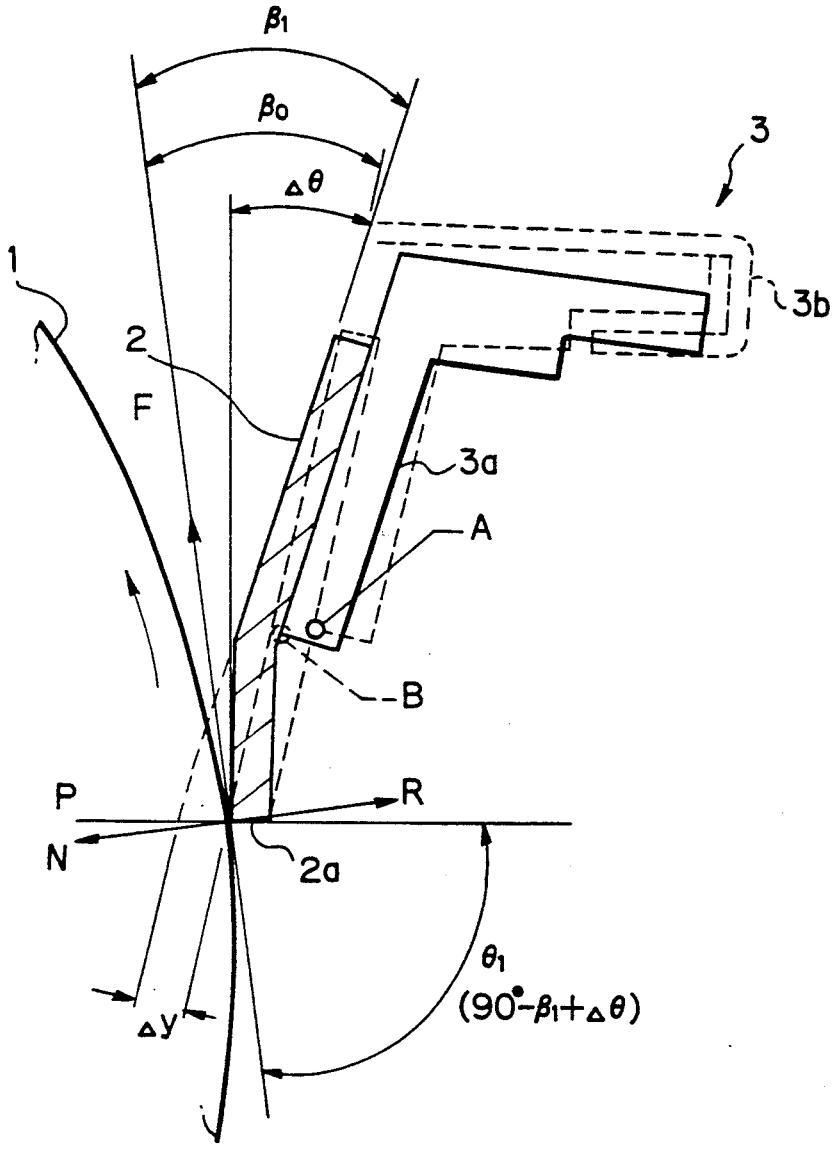

FIGS. 1A and 1B show the arrangement of a cleaning blade 2 included in the embodiment. Specifically FIG. 1A shows the cleaning blade, or simply blade, 2 in an unstressed position in which a load is not applied thereto by a spring or similar biasing means. FIG. 1B shows the blade 2 in a stressed position in which a predetermined load is applied thereto by the biasing means to hold the ridge 2a of the free end of the blade 2 in contact with the surface of a photoconductive drum 1 which is in rotation. In the illustrative embodiment, the drum 1 is rotated counterclockwise for effecting a copying operation. A main charger, optics for focusing light reflected by a document, a developing unit, an image transferring device, a paper separating device and other conventional units for electrophotography are arranged around the drum 1, although not shown in the figure.

The cleaning blade 2 is mounted on a blade support 3 made up of a holder support member 3b and a holder 3a. The holder support member 3b is rotatably mounted on a shaft 4 which extends in parallel with the axis of the drum 1. The blade 2 has a flat configuration and may be made of polyurethane rubber or a similar elastic material. The free end of the blade 2 protrudes a predetermined amount l from the free end of the holder 3a. The ridge 2a of the free end of the blade 2 positioned on the drum 1 side (having an angle of 90 degrees) contacts the surface of the drum 1. In this position, the blade 2 scrapes off a toner remaining on the surface of the drum 1 with the ridge 2a at an end face thereof. In the unstressed position shown in FIG. 1A, the above-mentioned ridge 2a of the blade 2 is spaced apart from the surface of the drum 1 and, therefore, cannot remove the remaining toner. The biasing means rotates the blade support 3 clockwise about the shaft 4 from the position of FIG. 1A to the position of FIG. 1B. In the stressed position shown in FIG. 1B, the free end of the blade 2 is deformed while the cleaning angle is changed from an angle $\theta_o$ particular to the stressed position to an angle $\theta_1$.

The present invention is based on the following findings. It is difficult to measure the cleaning angle $\theta_1$ itself while the cleaning operation is under way. The cleaning angle $\theta_1$ is determined by characteristic values including the Young's modulus E of the blade 2, the thickness t of the blade 2, the distance l over which the blade 2 protrudes from the holder 3a, the initial contact angle $\beta_o$ made between the surface of the blade 2 facing the drum 1 and the line tangential to the point of the drum surface which the ridge 2a of the blade 2 contacts when the ridge 2a is brought into contact with the drum surface with the biasing force via the holder 3a cancelled, the distance between the center of the shaft 4 and the point of contact of the ridge 2a under the above condition, the support angle $\alpha$ between the above-mentioned tangential line and the line connecting the center of the shaft 4 and the point of contact of the ridge 2a under the above condition, and the normal force F, i.e., the load per unit length of the blade 2 in the widthwise direction. These characteristic values were changed to evaluate the cleaning ability. As a result, it was found that when the cleaning ability is desirable, the Young's modulus, thickness t and distance l of the blade 2 as well as other values of interest satisfy the following relation:

$$\theta_1 = 90^\circ - \beta_0 - \tan^{-1}\left(\frac{4Nl^3 \times 10^{-3}}{Et^3} \times \frac{M-1}{Ml}\right) - \frac{1.08\,Nl^2}{Et^3\pi} \qquad \text{Eq. (1)}$$

The function $\theta$ having an angular dimension was found to lie in a predetermined range. When the cleaning angle $\theta_1$ during cleaning operation is 90 degrees, the function $\theta$ is an approximate formula expressed in terms of the Young's modulus E, thickness t and distance l of the blade 2 as well as other characteristic values.

How the Eq. (1) was derived will be described hereinafter.

(1) As shown in FIG. 1B, a force P continuously acts on and deforms the blade 2 while a cleaning operation is under way. The force P is generally expressed as:

$$P = N \cdot \sin\theta_1 - F \cdot \cos\theta_1$$

Therefore, P=N when $\theta_1$ is 90 degrees.

(2) The deformation of the free end of the blade 2 is equivalent to a deformation which a cantilever would undergo when received a load locally at the free end thereof. Hence, the deformation $\Delta y$ of the free end of the blade 2 is produced by:

$$\begin{aligned}\Delta y &= (P \times L) \cdot l^3/3EI \\ &= 4Nl^3/Et^3 \text{ (mm) (for } P = N \text{ and sectional secondary moment } I = l/12 \cdot Lt^3) \\ &= 4Nl^3 \times 10^{-3}/Et^3 \text{ (mm) for the dimensions are } N\{\text{g/mm}\},\ l\{\text{mm}\},\ E\{\text{kg/mm}^2\}, \text{ and } t\{\text{mm}^3\})\end{aligned}$$

(3) As the free end of the blade 2 is brought into contact with the surface of the drum 2, which is in rotation, via the holder 3a, the blade support 3 is rotated clockwise about the shaft 4 with the result that the ridge 2a of the blade 2 contacts the drum 1 to cause the free end of the blade 2 to deform. Consequently, the angle or contact angle between the surface of the blade 2 facing the drum 1 and the line tangential to the contact point of the drum surface changes from $\beta_0$, FIG. 1A, to $B_1$, FIG. 1B. As the free end of the blade 2 is deformed by $\Delta y$, the bend point of the blade 2 is shifted from a point A to a point B. Such a shift of the bend point is nearly equal to $\Delta y \times (M-1)/M$.

The contact angle as seen from the point of contact changes by the same amount as the shift of the bend point, i.e., by an amount $\Delta\beta$ nearly equal to $\tan^{-1}(\Delta y \times (M-1)/M \cdot l)$.

Therefore, the contact angle $\beta_1$ during operation is produced by:

$$\beta_1 = \beta_0 + \tan^{-1}(\Delta y \times (M \times l)/M \cdot l) \qquad \text{Eq. (2)}$$

(4) The deformation of the free end of the blade 2 corresponds to the deformation of the free end of a cantilever, as stated earlier. Therefore, the deformation angle $\Delta\theta$ of the free end of the blade 2 is:

$$\begin{aligned}\Delta\theta &= (N \times L)l^2/2EI \\ &= 6Nl^2/Et^3 \quad (\text{for } I = 1/12 \cdot Lt^3)\end{aligned}$$

By uniformizing the units, there is obtained:

$$\Delta\theta = 1.08\,Nl^2/(Et^3 \cdot \pi)\ \{^\circ\} \qquad \text{Eq. (3)}$$

(5) As shown in FIG. 1B, the cleaning angle $\theta_1$ during operation is expressed as $\theta_1 = 90 - \beta_1 + \Delta\theta$. By substituting Eqs. (2) and (3) for such an equation, there is produced Eq. (1).

How the cleaning ability is evaluated by changing the above-stated controllable characteristic values is as follows.

For the evaluation, the Young's modulus E of the blade 2 was changed in the range of 0.6–1.2 kg/mm$^2$, the thickness t of the blade 2 was selected to be 2 mm and 3 mm, the distance l of the blade 2 was changed in the range of 10–15 mm, the initial contact angle $\beta_0$ was changed in the range of 15–25 degrees, the support angle $\alpha$ was changed in the range of 10–35 degrees, and the normal force N was changed in the range of 0.7–3.2 g/mm (with respect to a case wherein the coefficient of dynamic friction $\mu$ of the blade 2 and drum surface was 0.8 and a case wherein it was 1.2). The amount of toner left on the surface of the drum 1 was measured at a position past the blade 2. It is to be noted that the coefficients of dynamic friction of 0.8 and 1.2 were measured when the drum 1 was cleaned with a toner actually deposited thereon, i.e., when a toner intervened between the surface of the drum 1 and the blade 2. When a toner did not intervene between the drum surface and the blade 2, the coefficients of dynamic friction were measured to be 1.2 and 1.7 greater than the above-mentioned ones. For the above evaluation, the surface of the drum 1 was moved at three different linear velocities (300 mm/sec, 400 mm/sec and 500 mm/sec).

Figure 2:
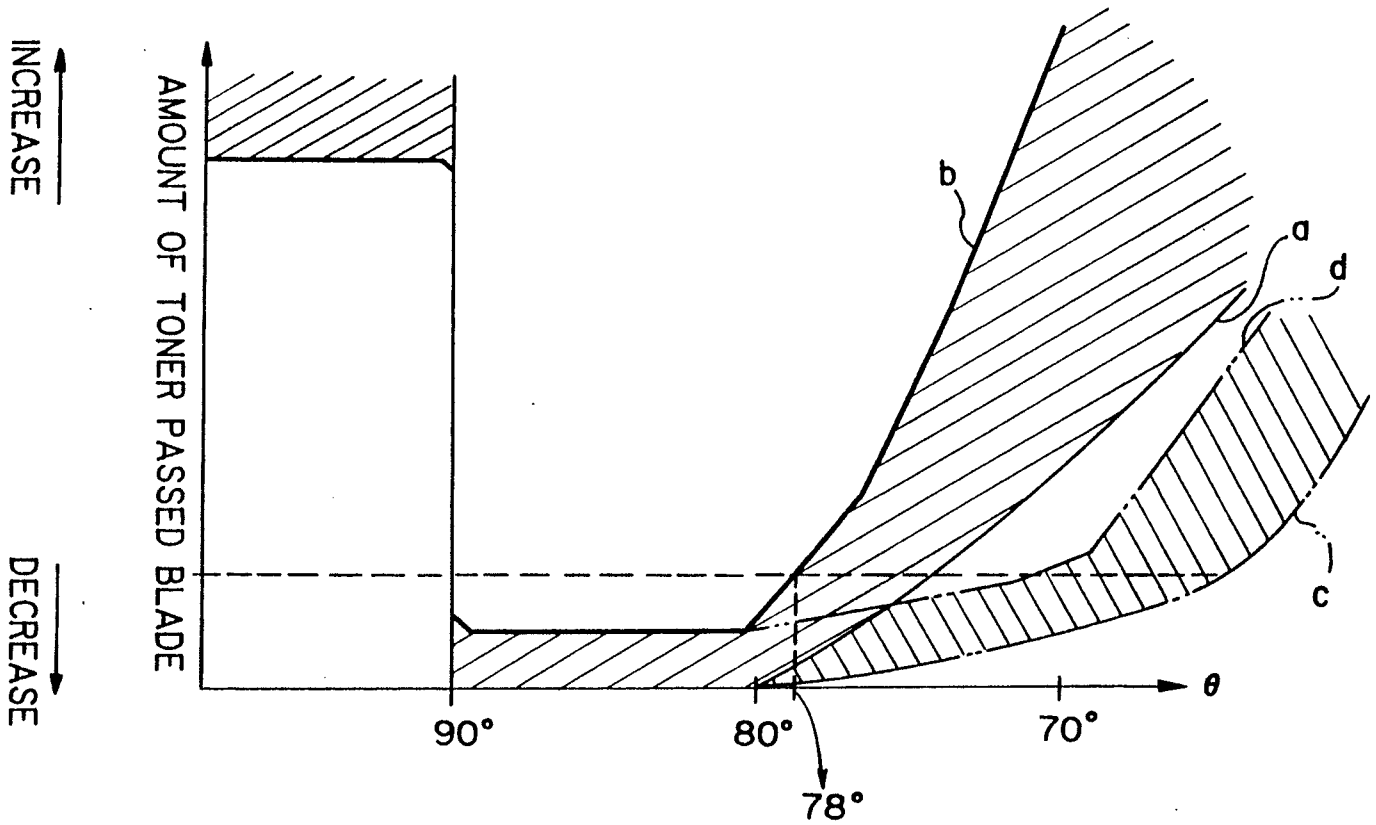
FIG. 2 is a graph indicative of a cleaning ability achievable with the embodiment.

FIG. 2 is a graph indicative of the result of measurement. In the graph, the ordinate indicates the amount of toner remaining on the drum 1 and passed the blade 2 while the abscissa indicates the value of the previously stated function $\theta$. Curves a and b are respectively representative of the lower limit and the upper limit of the distribution of the amounts of toner passed the blade 2. A dashed line shows the lower limit below which the toner would smear images.

Figure 4A:
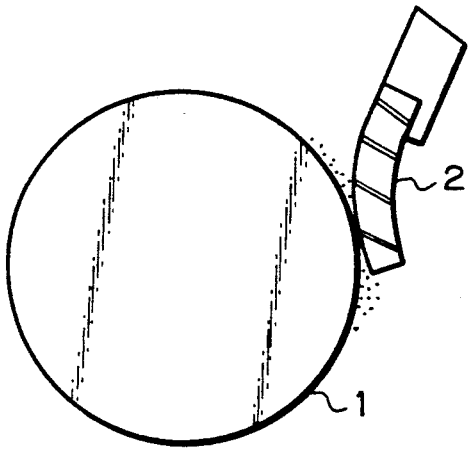
FIGS. 4A and 4B show respectively the cleaning blade in a condition wherein it contacts the photoconductive drum at the side thereof and in a condition wherein it is entrained by the drum.

In FIG. 2, when the value of the function $\theta$was greater than or equal to 70 degrees and smaller than 90 degrees, the amount of toner passed the blade 2 was zero or extremely small and did not effect the image quality, i.e., a desirable cleaning ability was obtained. As shown in FIG. 4, values of the function $\theta$ greater than 90 degrees cause the blade 2 to contact the drum 1 at the side thereof (cleaning angle $\theta_1$ being substantially 90 degrees when $\theta$ is 90 degrees). Then, the ridge 2a of the free end of the blade 2 is lifted away from the surface of the drum 1, allowing a great amount of toner to pass it and thereby sharply lowering the cleaning ability.

On the other hand, values of the function $\theta$ smaller than 78 degrees cause a relatively great amount of toner to pass the blade 2 and thereby smear images. Especially, when the normal force N is relatively small or when the thickness t of the blade 2 is great, the blade 2 noticeably vibrates to cause a great amount of toner to pass it. Further, when the normal force N is great, the ridge 2a of the free end of the blade 2 is strongly urged against the drum 1 to damage the photoconductive layer of the drum 1 or to be damaged itself to increase the amount of toner. Moreover, when the normal force N is great and the Young's modulus E and thickness t are small, the free end of the blade 2 is entrained by the drum 1, as shown in FIG. 4B, again increasing the amount of toner to pass the blade 2.

Figure 3:
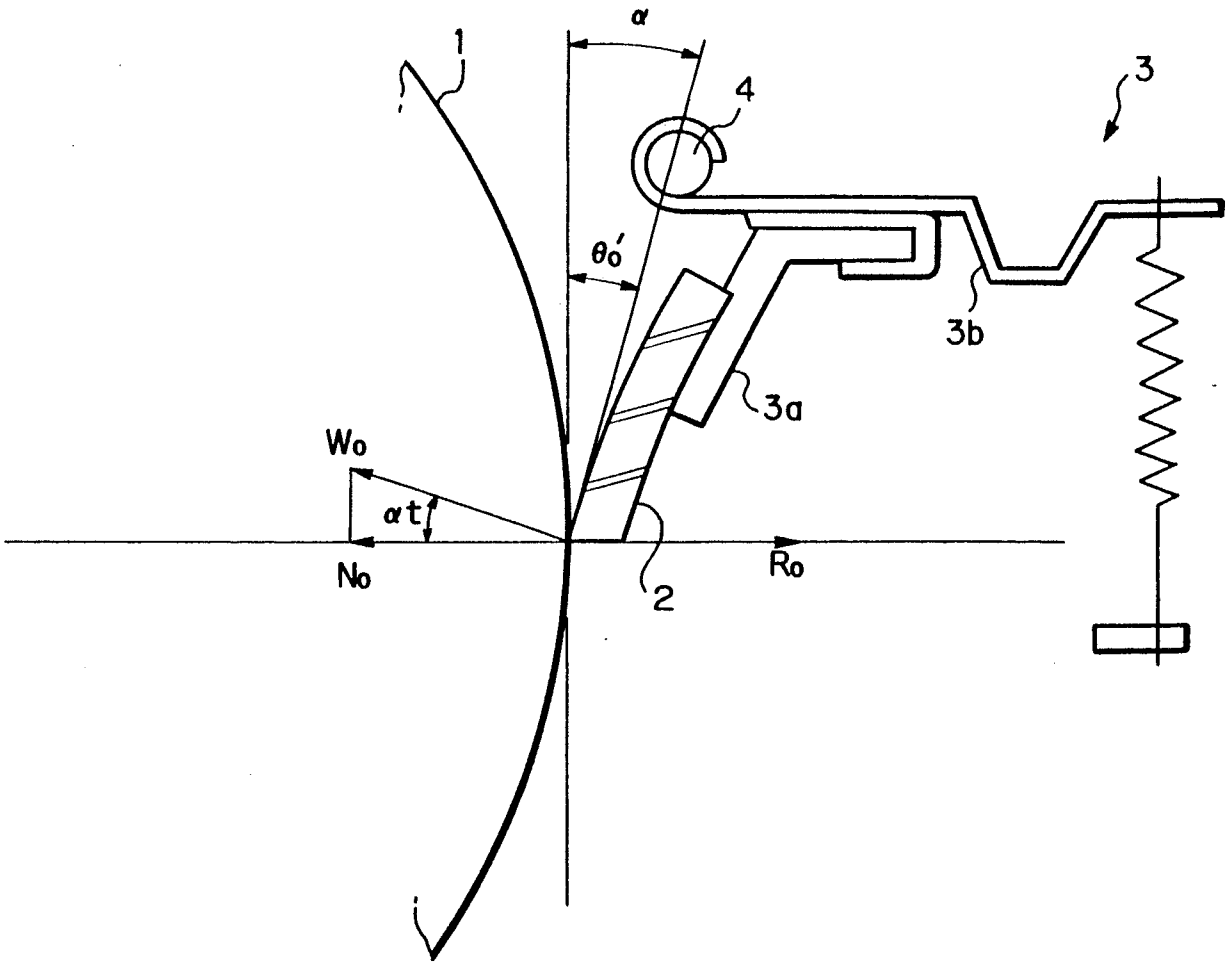
FIG. 3 shows how the cleaning blade is pressed while a photoconductive drum is in a halt.
Figure 4B:
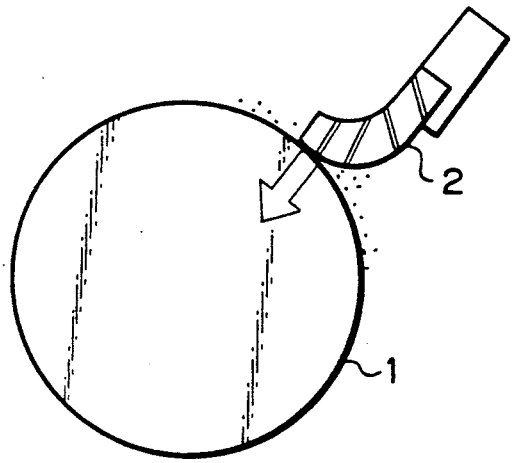

As stated above, so long as the value of the function $\theta$ is greater than or equal to 78 degrees and smaller than 90 degrees, the amount of toner passed the blade 2 is zero or extremely small, insuring a desirable cleaning ability. Experiments also showed that when the support angle $\alpha$ is smaller than 25 degrees, the amount of toner passed the blade 2 is relatively small (approaches the lower limit $\alpha$, FIG. 2), allowing the blade 2 to be machined and assembled with a substantial margin with respect to the thickness t, distance l, etc. Specifically, while a cleaning operation is under way with the drum 1 being rotated, the doubling function of a leading mechanism is exhibited due to the friction F ($\mu$N) between the ridge 2a of the free end of the blade 2 and the surface of the drum 1. As a result, the spring load W acting on the ridge 2a (referred to as a spring load during operation hereinafter) becomes heavier than a spring load $W_0$ which acts when the drum 1 is not in rotation (referred to as an initial spring load hereinafter). The change in spring load occurring on the transition of the drum 1 from a halt to a rotation is apt to cause the blade 2 to vibrate and/or cause the free end of the blade 2 to be entrained by the drum 1, as shown in FIG. 4B. Such a change in spring load can be maintained relatively small so long as the above-mentioned support angle $\alpha$ is smaller than 25 degrees. More specifically, as shown in FIG. 3, assume that the blade support 3 is rotated clockwise about the shaft 4 by biasing means in the form of a spring, pressing the ridge 2a of the free end of the blade 2 against the surface of the drum 1 which is in a halt. In this condition, the initial load $W_0$ acts in a direction perpendicular to the line connecting the center of the shaft 4 and the point of contact. In FIG. 3, $N_0$ and $R_0$ indicate an initial normal force and an initial drag, respectively. As the drum 1 is rotated to be cleaned, a moment of rotation is generated around the shaft 4 due to the friction F ($\mu R = \mu N$) between the ridge 2a of the blade 2 and the surface of the drum 1, as shown in FIG. 1B. As a result, the spring load during operation W is increased in proportion to the moment of rotation:

$$W = W_0 + \frac{M \cdot \text{Sin}\,\alpha \times F}{M}$$

$$W = W_0(1 + \mu \text{Sin}\,\alpha \cdot \text{Cos}\,\alpha) \quad (\text{for } F = \mu \cdot \text{Cos}\,\alpha)$$

This is the doubling function of a leading mechanism, and ($1+\mu$ sin $\alpha$·Cos $\alpha$) is the doubling factor.

Doubling factors determined by calculation well matched doubling factors determined by actual measurement, as shown in Tables 1 and 2 below. This proves that the above-described doubling action actually occurs. Tables 1 and 2 list measured values and calculated values with respect to a support angle $\alpha$ of 11 degrees and a support angle of 25 degrees, respectively. The coefficients of dynamic friction are 0.8 and 1.2 in both of Tables 1 and 2.

TABLE 1

| $\mu$ | MEASURED | CALCULATED |
|---|---|---|
| 0.8 | 1.1 | 1.15 |
| 1.2 | 1.1 | 1.22 |

TABLE 2

| $\mu$ | MEASURED | CALCULATED |
|---|---|---|
| 0.8 | 1.5 | 1.31 |
| 1.2 | 1.5 | 1.46 |

As the above equation indicates, the magnitude of the doubling action increases with the increase in support angle $\alpha$. Hence, as the support angle $\alpha$ increases, the blade 2 is more apt to vibrate or otherwise behave in an undesirable manner. This, in the worst case, damages the drum 1 and/or the ridge of the free end of the blade 2. In fact, experiments showed that as the support angle $\alpha$ increases, the amount of toner passed the blade 2 tends to approach the upper limit b, FIG. 2, due to, for example, the vibration of the blade 2. It was also found that so long as the support angle $\alpha$ is greater than 0 degrees and smaller than 25 degrees, the amount of toner passed the blade 2 remains relatively small despite the vibration or similar behavior of the blade 2.

Further, it was found that even when the value of the function $\theta$ is greater than or equal to 78 degrees and smaller than 90 degrees, the amount of toner passed the blade 2 is relatively small (approaches the lower limit $\alpha$, FIG. 2) if the normal force N lies in the range of 0.3–3 g/mm. This accommodates greater irregularities regarding the thickness t and distance l of the blade 2 and so forth in the event of machining and assembly.

When the normal force N was smaller than 0.3 g/mm, the blade 2 failed to contact the drum 1 stably along the ridge 2*a* thereof and left a relatively broad area of the drum 1 uncleaned in a stripe configuration while causing the free end thereof to shake. On the other hand, normal forces greater than 3 g/mm scratched or otherwise damaged the ridge 2*a* of the free end of the blade 2 and the drum 1.

Furthermore, even when the value of the function $\theta$ was greater than or equal to 78 degrees and smaller than 90 degrees, the amount of toner passed the blade 2 was relatively small (approached the lower limit $\alpha$, FIG. 2) if the blade was made of a material whose hardness was 60–80 degrees. Again, this enhances the margin regarding the irregularities particular to machining and assembly. Hardness greater than 80 degrees made the contact of the blade 2 with the drum 1 unstable along the ridge 2*a* at a small pitch. As a result, the amount of toner passed the blade 2 was close to the upper limit b, FIG. 2 to cause a number of relatively narrow black stripes to appear in an image.

The toner to be removed by the blade 2 is electrostatically deposited on the surface of the drum 1. The higher the linear velocity of the surface of the drum 1, the greater the amount of toner to pass the blade 2 is, i.e., the lower the toner removing ability is. The cleaning ability was evaluated under the previously stated conditions except that the drum 1 was driven at a linear velocity of 200 mm/sec. The evaluation resulted in a distribution of the amounts of toner passed the blade 2 which is different from the distribution associated with the linear velocity higher than 300 mm/sec. Specifically, when the value of the function $\theta$ was greater than 80 degrees, the amount of toner passed the blade 2 was smaller when the linear velocity is 200 mm/sec than when it was greater than 300 mm/sec. This is indicated in FIG. 2 by dashed curves c and d representative of an upper limit and a lower limit, respectively. By comparing such a distribution with the dashed line representative of the lower limit regarding smears on an image, it will be seen that if the value of the function $\theta$ is greater than or equal to 70 degrees and smaller than 90 degrees, the amount of toner passed the blade 2 is small enough to insure high image quality. However, to further enhance the margin regarding the cleaning ability or to drive the drum 1 at a linear velocity higher than 300 mm/sec, it is necessary that the value of the function $\theta$ be greater than or equal to 78 degrees and smaller than 90 degrees.

The friction acting on the free end of the blade 2 when it is in contact with the drum 1 increases with the increase in the coefficient of dynamic friction $\mu$ of the blade 2 and drum 1. Then, the contact of the blade 2 with the drum 1 becomes unstable while the toner transporting force on the drum 1 increases, obstructing the removal of the toner by the blade 2. To evaluate the cleaning ability, use was made of a drum 1 made of amorphous silicone ($\alpha$-Si) and set up a coefficient of dynamic friction which was 0.9 when a toner was absent between the blade 2 and the drum 1 and 0.7 when the former was present between the latter. The other conditions for the evaluation were the same as for the previous evaluation. The evaluation resulted in a distribution wherein the amount of toner passed the blade 2 decreases when the value of the function $\theta$ is greater than 80 degrees, as also indicated by the upper limit c and lower limit d in FIG. 2. Again, by comparing the upper limit c and lower limit d with the dashed line associated with the smears on an image, it will be seen that the amount of toner passed the blade 2 is relatively small if $\theta$ is greater than or equal to 70 degrees and smaller than 90 degrees, insuring high image quality. However, to further enhance the margin regarding the cleaning ability or when the coefficient of dynamic friction $\mu$ is greater than 1.0 in the absence of a toner between the blade 2 and the drum 1, the value of the function $\theta$ should be greater than or equal to 70 degrees and smaller than 90 degrees, as stated earlier.

In summary, it will be seen that the present invention provides a cleaning device in which during cleaning operation a cleaning angle implementing a desirable cleaning ability is set up to protect an image from smears ascribable to defective cleaning and to prevent a cleaning blade from contacting an image carrier at the side thereof or being entrained by the image carrier.

The cleaning blade is prevented from vibrating or being entrained by the image carrier due to an increase in load which it exerts on the image carrier. The cleaning blade, therefore, removes toner stably from the image carrier at all times. This enhances the margin regarding the configuration of the blade including the thickness and the amount of protuberance in the event of machining and assembly.

Various modifications will become possible for those skilled in the art after receiving the teachings of the present disclosure without departing from the scope thereof.

What is claimed is:

1. In a cleaning device comprising a blade support supported by a shaft which is parallel to a surface of an image carrier and perpendicular to an intended direction of movement of said surface, and a cleaning blade affixed to said blade support such that a free end of said cleaning blade protrudes a predetermined amount from free end of said blade support, said free end of said cleaning blade having a flat end surface and being pressed against said surface of said image carrier via said blade support for removing a toner remaining on said image carrier surface, the following equation is satisfied $$\theta_1 = 90^\circ - \beta_0 - \tan^{-1}\left(\frac{4Nl^3 \times 10^{-3}}{Et^3} \times \frac{M-1}{Ml}\right) - \frac{1.08\,Nl^2}{Et^3\pi}$$

where E is a Young's modulus of said cleaning blade, t is a thickness of said cleaning blade, l is said predetermined amount, $\beta_o$ is an angle set up, when a pressure acting on said cleaning blade via said support member is cancelled and a ridge of said free end of said cleaning blade is held in contact with said surface of said image carrier, between a surface of said cleaning blade facing said surface of said image carrier and a line tangential to said surface of said image carrier at a point of contact of said ridge, M is a distance between the center of said shaft and said point of contact under the above condition, N is a load acting on every unit length of said cleaning blade in a widthwise direction while a cleaning operation is under way, and $\theta_1$ is an angle formed between the line tangential to said surface of said image carrier at the point of contact of the ridge with said surface of said image carrier and the flat end surface of the cleaning blade is greater than or equal to 78 degrees and smaller than 90 degrees.

2. A cleaning device as claimed in claim 1, wherein an angle $\alpha$ between said surface of said cleaning blade facing the surface of the image carrier and a line connecting the center of said shaft and the point of contact is greater than 0 degrees and smaller than or equal to 25 degrees.

3. A cleaning device as claimed in claim 1, wherein the load N is greater than 0.3 g/mm and smaller than or equal to 3 g/mm.

4. A cleaning device as claimed in claim 1, wherein said cleaning blade is made of a substance whose hardness is 60–80 degrees.

5. A cleaning device as claimed in claim 1, wherein the surface of the image carrier is moved at a linear velocity higher than 300 mm/sec.

6. A cleaning device as claimed in claim 1, wherein a coefficient of dynamic friction between the surface of the image carrier and said cleaning blade is greater than 1.0 when a developer is absent between said surface of said image carrier and said cleaning blade.

* * * * *